United States Patent [19]

Decandia

[11] Patent Number: 4,590,544

[45] Date of Patent: May 20, 1986

[54] LIGHTING FIXTURE WITH CONDUIT ADAPTABLE WIRE COVER

[75] Inventor: Giovanni Decandia, Germantown, Tenn.

[73] Assignee: FL Industries, Inc., Livingston, N.J.

[21] Appl. No.: 653,134

[22] Filed: Sep. 24, 1984

[51] Int. Cl.[4] ..... F21S 1/02

[52] U.S. Cl. ..... 362/368; 362/147; 362/375; 362/457

[58] Field of Search ..... 362/147, 368, 375, 457

[56] References Cited

U.S. PATENT DOCUMENTS

| | | | |
|---|---|---|---|
| 1,119,050 | 2/1914 | Smith | 362/147 |
| 1,650,347 | 11/1927 | Hamilton | 362/368 |
| 3,919,459 | 11/1975 | Steenhoven | 362/368 |
| 4,141,061 | 2/1979 | Ford | 362/368 |
| 4,234,916 | 11/1980 | Goralnik | 362/368 |
| 4,302,798 | 11/1981 | Sit | 362/368 |
| 4,356,540 | 10/1982 | Goralnik | 362/368 |
| 4,384,316 | 5/1983 | Hendrick | 362/368 |
| 4,449,168 | 5/1984 | Ewing | 362/147 |

*Primary Examiner*—Ronald B. Cox

*Attorney, Agent, or Firm*—Laff, Whitesel, Conte 6 Saret

[57] ABSTRACT

A lighting fixture is provided having a rear housing and a front housing including a refractor. The rear housing includes a first opening adapted to receive a wiring conduit. The rear housing also has a second opening adapted to receive separate wires for the lighting fixture. The second opening has a boss or rim extending inwardly around its inner edge. The rim is adapted to receive a cover against one of its edges if the separate wires are used and against the other of its edges if the wiring conduit is used to supply electricity to the lighting fixture.

12 Claims, 2 Drawing Figures

LIGHTING FIXTURE WITH CONDUIT ADAPTABLE WIRE COVER

BACKGROUND OF THE INVENTION

The present invention relates to a lighting fixture and, more particularly, to a lighting fixture having a wiring opening with a boss adapted to receive a cover.

Lighting fixtures of the type to which the present invention relates typically comprise a back housing of a generally flat, generally rectangular shape and a front housing of a five sided, box-like shape having an open face mounted to the rear housing. Depending on the desired type of installation, the electrical wires enter the lighting fixture in one of two ways. When the lighting fixture is to be mounted to a pole or a wiring box and separate wires are present to supply the lighting fixture, these wires enter the fixture through a wiring opening in the rear face of the back housing. When the lighting fixture is to be mounted flush to a wall and the electrical wires are brought to the fixture by a conduit, the conduit itself will enter the fixture through an opening in the bottom of the back housing. Such choice of assemblies requires two different back housings to be available, one of which would accommodate separate wires through the wiring opening cover and one of which would close the opening and yet accommodate the wires from a conduit through a bottom opening in the back housing.

Accordingly, it is an object of the invention to provide a lighting fixture capable of receiving either a separate wire or a conduit electrical supply.

SUMMARY OF THE INVENTION

The present invention lighting fixture comprises a back housing of a generally flat, generally rectangular shape, although other shapes as desired can be considered part of the present invention. A front housing of a five sided, box-like shape is adapted to have its open face fit over the rear housing. Of course, if the rear housing were a circular or other shape, the front housing would be of a corresponding shape. The back housing has one opening in its rear surface adapted to receive the separate wires supplying the electricity to the fixture. A cover is adapted to abut bosses or a rim extending into the opening in a manner to permit the wires to enter the fixture while closing the opening. The cover may also be mounted to accept a conduit feed. The back housing in that case would also have another opening in its bottom surface adapted to receive a conduit containing wires to supply electricity to the fixture. This second opening could be plugged by a cover or a screw in plug to seal it closed if the supply wires were brought through the rear surface opening. The cover over the first opening in the rear housing is adapted to be mounted on either side of the bosses to accommodate either the wire supply through the opening in the rear surface or the conduit supply through the second opening in the bottom surface, depending on the type of rear housing selected.

The rear housing usually comprises a one piece die cast metal assembly, and is usually formed of aluminum or an alloy thereof. The edges of the rear housing are fit with a gasket. The front housing has a lip adapted to fit over the edge of the rear housing in sealed engagement with the gasket. An opening in the rear face of the rear housing also has a gasket surrounding its outer edge to assure a sealed engagement with a flat surface or a supply box to which the lighting fixture is mounted. Another opening or conduit passage is present in the bottom edge of the rear housing. A boss or rim protrudes inwardly into the opening in the rear face from the edge of the opening in the rear face. This rim is adapted to receive a cover plate on either the inward facing or outward facing side of the rim. Usually if the fixture is being supplied electricity from separate wires entering the rear face opening from a supply box to which the rear housing is mounted, the plate will be mounted on the inward facing side of the rim. A plug will close the bottom housing opening in such case. However, if the fixture is being supplied electricity from a conduit entering the second opening in the housing the cover plate will be mounted on the outward facing side of the rim to assure space for the conduit wires within the fixture.

Mounting brackets extend inwardly from the rear housing, usually from locations adjacent the opening in the rear face and the inner protruding boss. A reflector is mounted to these brackets in a manner such that the reflector extends over the first opening. The usual lamp, racket, ballast and other necessary electrical elements are also present in the housing.

In particular, the present invention provides a lighting fixture comprising a generally flat rear housing, a raised front housing adapted to be mounted to said rear housing to form a lighting fixture, said rear housing including a first opening adapted to receive a wiring conduit, said rear housing further including mounting means adapted to receive a reflector assembly, a second opening, and boss means protruding inwardly into said second opening, said boss means adapted to receive a cover over said second opening.

DESCRIPTION OF THE PREFERRED EMBODIMENT

Figure 1:
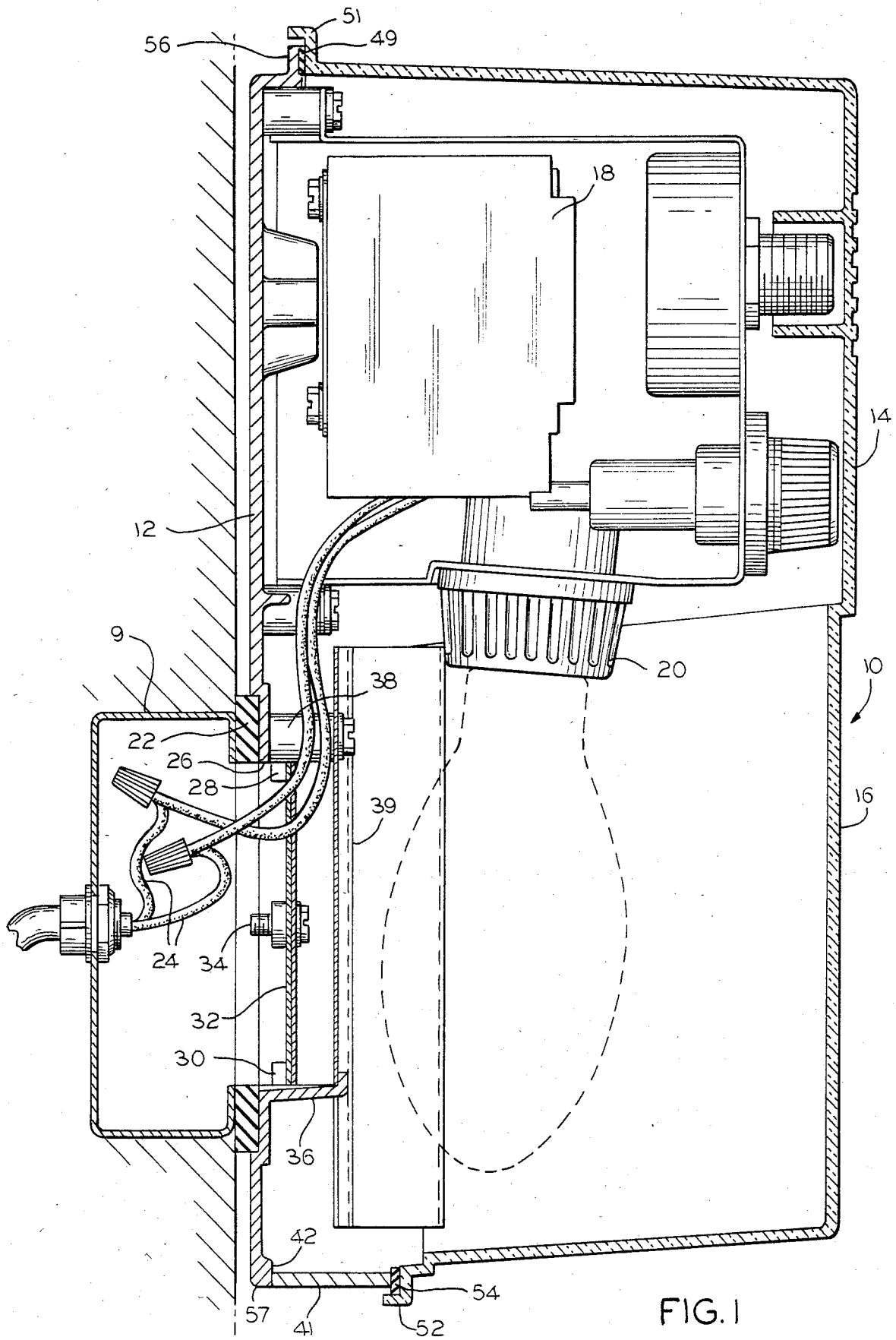
FIG. 1 is a side, partial cross sectional view of a lighting fixture in accordance with one embodiment of the present invention.

Referring now to FIG. 1 of the drawings, a lighting fixture in accordance with the present invention is shown generally at 10. A generally flat, generally rectangular shaped rear housing 12 is formed of die cast aluminum and is mounted to supply box 9. Five-sided, box-shaped front housing 14 is mounted against rear housing 12. The mounting occurs along edges 56, 57 of rear housing 12, and along side edges which are not shown, and includes gaskets 49, 54 between edges 56, 57 and raised lip 51, 52 of front housing 14. Front housing 14 is also usually of die cast aluminum, except for refractor 16 which is a clear plastic or glass. Typically, lighting fixture 10 includes starter 18 supplied by electrical wires 24 and lamp socket 20.

A circular opening 26 is present in the rear surface of rear housing 12. Bosses or rims 28, 30 extend into opening 26 from the edges of rear housing 12 surrounding opening 26. Mounting brackets 36, 38 extend into lighting fixture 10 from the edges of rear housing 12 near opening 26. Reflector 39 is mounted to brackets 36, 38. A plug 41 closes a second opening 42 in the bottom of rear housing 12.

Cover plate 32 abuts rims 28, 30 from their inward side to cover opening 26. Plate 32 is held in place by bolts 34. Plate 32 is adapted to permit electrical supply wires 24 to enter fixture 10. Bolt 34 is affixed to a mounting surface (not shown), which surface also abuts gasket 22 to seal opening 26 against supply box 9.

Figure 2:
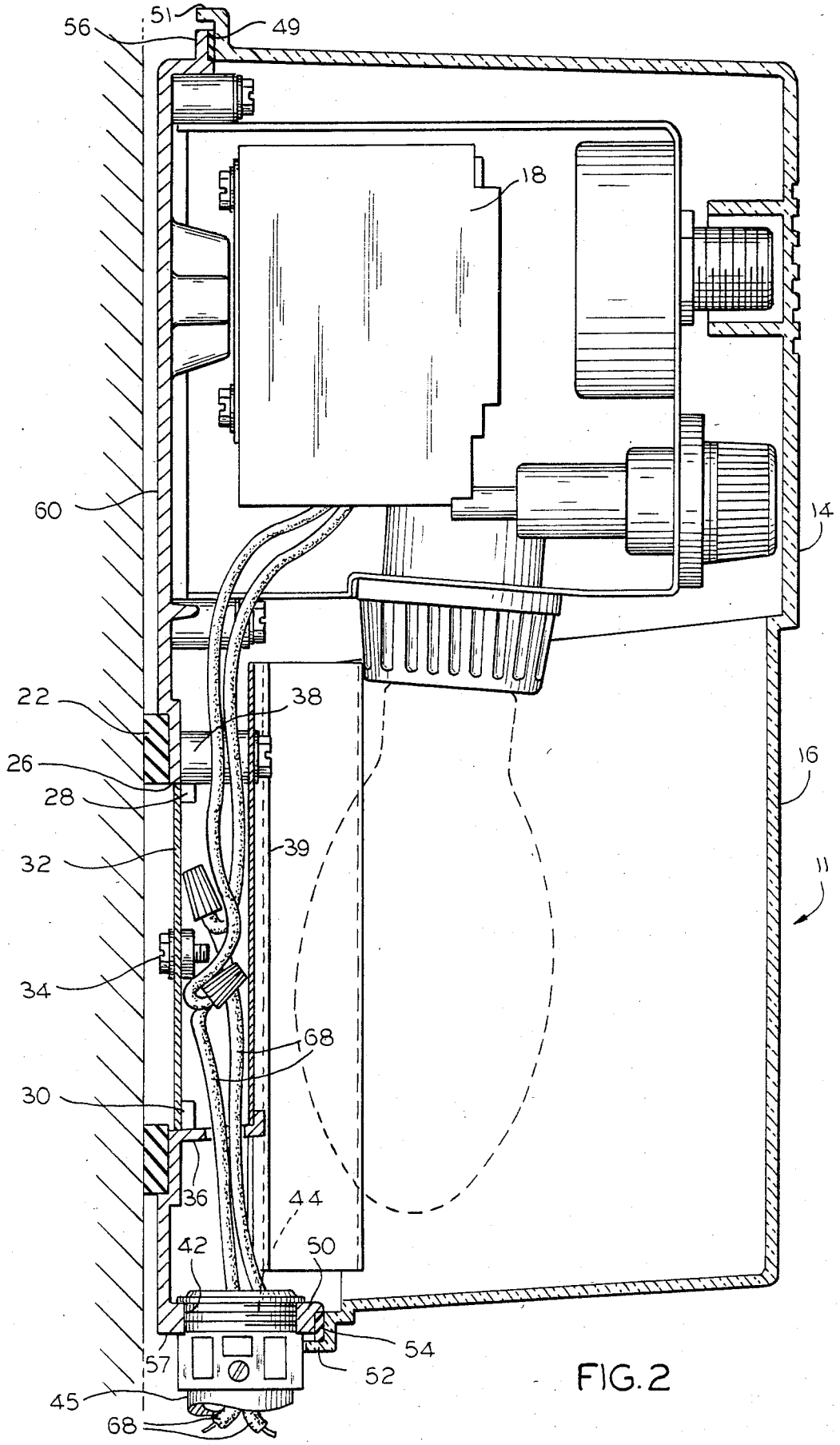
FIG. 2 is a side, partial cross sectional view of a lighting fixture in accordance with a second embodiment of the present invention.

Referring now to FIG. 2, a second embodiment of a lighting fixture of the present invention is shown generally at 11. Similar items to the embodiment shown in FIG. 1 are numbered identically and will not be described further. A second opening 42 is present in the lower surface of rear housing 60. Plug 41 has been removed. Conduit 45 containing electrical supply wires 68 enters opening 42 in rear housing 60. Plate 32 would then be mounted to the outward facing sides of rims 28, 30 to make room for wires 68 to enter fixture 10.

What is claimed is:

1. A lighting fixture comprising:

a generally flat rear housing;

a raised front housing adapted to be mounted to said rear housing to form a lighting fixture;

said rear housing including a first opening adapted to receive a wiring conduit;

said rear housing further including mounting means adapted to receive a reflector assembly;

a second opening, and boss means protruding inwardly into said second opening;

said boss means adapted to receive a cover over said second opening.

2. A lighting fixture comprising:

a rear housing having an opening adapted to receive electrical wires into said fixture and a raised boss in said opening having a front surface and a rear surface;

a reflector mounted to said rear housing;

a cover adapted to be selectively mounted to either said front surface or said rear surface of said boss to cover said opening in said rear housing; and a front housing in engagement with said rear housing.

3. A lighting fixture comprising:

a rear housing in the form of a generally planar, rectangular plate including an opening adapted to receive electrical wires into said fixture and mounting means protruding inwardly around said opening, said mounting means adapted to receive a reflector, said rear housing further including boss means having opposing sides protruding inwardly into said opening from said mounting means;

a cover adapted to be mounted to either of said opposing sides of said boss means; and a front housing in engagement with said rear housing.

4. A lighting fixture comprising:

a generally flat rear housing including a first opening adapted to receive a wiring conduit, said rear housing further including mounting means adapted to receive a reflector assembly, said rear housing having a second opening adapted to receive electrical wires;

boss means on said rear housing including a raised rim having opposing sides protruding inwardly into said second opening, said boss means adapted to removably receive a cover in said second opening on either of said opposing sides of said rim; and a raised front housing adapted to be mounted to said rear housing.

5. The lighting fixture of claim 2, wherein:

said rear housing includes mounting means, and said reflector includes openings in cooperation with said rear housing mounting means to enable said reflector to be mounted in engagement with said rear housing.

6. The lighting fixture of claim 2, wherein:

the opening in the rear housing is generally aligned with the reflector in said housing.

7. The lighting fixture of claim 2, wherein:

said front housing includes a refractor element.

8. The lighting fixture of claim 7, wherein:

said boss means comprises a raised rim extending inwardly into said second opening in said rear housing, with said boss means adapted to receive said cover on either side of said rim.

9. The lighting fixture of claim 7, wherein:

said front housing includes a refractor element.

10. The lighting fixture of claim 7, including a reflector assembly fitted to said mounting means on said rear housing;

said reflector assembly when so mounted covering said second opening of said rear housing.

11. The lighting fixture of claim 7, wherein:

said first opening comprises a threaded, circular opening adapted to receive a threaded conduit plug.

12. The lighting fixture of claim 7, wherein:

said rear housing comprises a generally flat, generally rectangularly shaped die cast metal assembly;

said front housing comprises a five sided, box-like assembly having an open face adapted to fit against said rear housing;

a cover fitted against said boss means in said second opening to cover said second opening, said boss means extending inwardly into said second opening with certain of said mounting means adjacent said second opening.

* * * * *